United States Patent [19]

Bridger

[11] 4,097,942

[45] Jul. 4, 1978

[54] PORTABLE CRIB CONSTRUCTION

[76] Inventor: Abraham A. Bridger, 125 E. 94th St., New York, N.Y. 10028

[21] Appl. No.: 837,143

[22] Filed: Sep. 28, 1977

[51] Int. Cl.[2] ..... A47B 9/00

[52] U.S. Cl. ..... 5/93 B; 5/99 R; 5/99 B; 5/98 R

[58] Field of Search ..... 5/93 R, 98 R, 99 R, 5/99 A; 312/244

[56] References Cited

U.S. PATENT DOCUMENTS

| | | | |
|---|---|---|---|
| 1,105,156 | 7/1914 | Oliphant | 5/98 R |
| 1,288,518 | 12/1918 | Collier | 5/98 R |
| 1,412,177 | 4/1922 | Glaum | 5/98 R |
| 3,094,714 | 6/1963 | Lutes | 5/99 R |
| 3,631,548 | 1/1972 | Dahab | 5/99 R |
| 3,722,009 | 3/1973 | Hrynda | 5/93 R |

*Primary Examiner*—Casmir A. Nunberg
*Attorney, Agent, or Firm*—Charles E. Temko

[57] ABSTRACT

A portable crib construction of a type which may be folded to suitcase dimensions in which the end walls of the erected crib are rotated through 270° upon erection to enable the side walls of a base element to serve to elevate the crib bottom from a floor or other horizontal support, thereby eliminating the need for separate retractable legs. The longitudinal side walls of the crib are formed by foldable canvas panels which are separately attached to the base element by resilient fasteners, thereby permitting the erected crib to have a greater length to width ratio than has heretofore been possible in prior art constructions.

3 Claims, 6 Drawing Figures

PORTABLE CRIB CONSTRUCTION

BACKGROUND OF THE INVENTION

This invention relates generally to the field of portable cribs suitable for use by infants, which may be collapsed or folded to rectangular configuration of dimensions approximating that of a suitcase. Devices of this type are known in the art, and the invention lies in specific constructional details which provide improved facility in manipulation, lighter weight, increased rigidity, and the ability to offer a length to width ratio closer to that of a conventional permanent type crib, and a greater erected to folded size ratio than has been possible in prior art construction.

In U.S. Pat. No. 3,722,009, granted Mar. 27, 1973 to Helen R. Hrynda, there is disclosed a portable crib of the above described type which offers a high degree of utility when compared to other prior art devices. This construction provides a base element including three hingedly connected planar members which, in folded condition, form the sides, bottom and ends of a suitcase-like structure which may be carried by a handle. When the crib is erected, the base element assumes a planar configuration, the upper surface of which supports a mattress. Hingedly interconnected end walls are then rotated through a 90° angle. Side walls are in turn connected to one vertical edge of each of the end walls, and they are unfolded in sequence whereby the free ends thereof are selectively joined to adjacent edges of oppositely disposed end walls. Finally, a plurality of leg elements are rotated to erect position to elevate the base element from a floor upon which the crib rests to avoid drafts and provide a more sanitary installation.

Because the side walls are formed to include a plurality of vertical stiles interconnected between upper and lower horizontal members, they are usually formed in two mutually hinged sections, one section being hinged to an end wall. When in stored condition, they are folded much like a carpenter's rule, and when unfolded, they result in a crib in which the length thereof is substantially twice the width. As a child grows, this ratio necessitates a cramped sleeping position unless the overall width of the crib is unduly large. Moreover, the weight of the side walls contributes greatly to the overall weight of the device, an important factor when it is carried. The provision of foldable leg elements and locking means therefore also imparts additional weight and complexity, as it is possible to utilize other components of the device to obtain the equivalent function.

SUMMARY OF THE INVENTION

Briefly stated, the invention contemplates the provision of an improved folding crib construction of the class described, in which the above mentioned disadvantages have been substantially eliminated, by materially simplifying the component structure without any loss of equivalent function. In keeping with this objective, the end walls are foldably interconnected to the base element which forms the floor of the erected crib in such manner that they are rotated through substantially 270° upon erection, so that certain base element members which previously formed end walls of the folded crib structure serve the function of deleted legs in elevating the erected crib base wall from a floor upon which it is supported. The end walls are provided with laterally extending flanges which provide a longitudinally oriented force which is countered by the engagement of a pair of horizontally disposed upper side rails. The side rails support the upper edges of canvas side wall panels, the lower side edges being secured to the base element by resilient fastener elements. The canvas side panels are thereby placed in substantial tension adding to the overall rigidity of the device.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
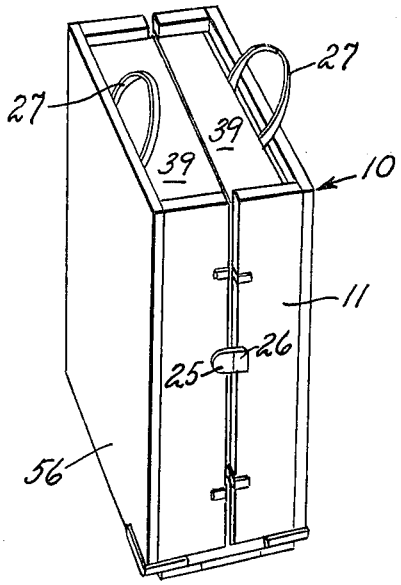
FIG. 1 is a view in perspective of an embodiment of the invention showing the same in folded or stored condition.

In accordance with the invention, the device, generally indicated by reference character 10, comprises broadly: a base element 11, first and second end wall elements 12 and 13, respectively, first and second side wall elements 14 and 15, respectively; and a foldable mattress 16.

The base element 11 is most suitably formed from plywood synthetic resin or other similar material, and includes first and second equally sized relatively large walls 17 and 18, respectively, a bridging wall 19 hingedly connected thereto by first and second hinge means 20 and 21. Each of the walls 17 and 18 includes first and second longitudinal flanges 23 and 24, respectively. Interconnecting hardware 25 and 26 (FIG. 1) provide means for maintaining the same in collapsed or stored condition. Carrying straps 27 or similar grips permit the device to be carried when not in use.

Located at the transverse edges 28 and 29 of the walls 17 and 18 are generally planar end walls 30 and 31 interconnected thereat by hinge means 32 and 33. The walls 30–31 are bounded by lower edges 34, side edges 35 and upper free edges 36. At the lower edges 34 are laterally extending flanges 37 having upper surfaces 38 and lower surfaces 39.

Figure 2:
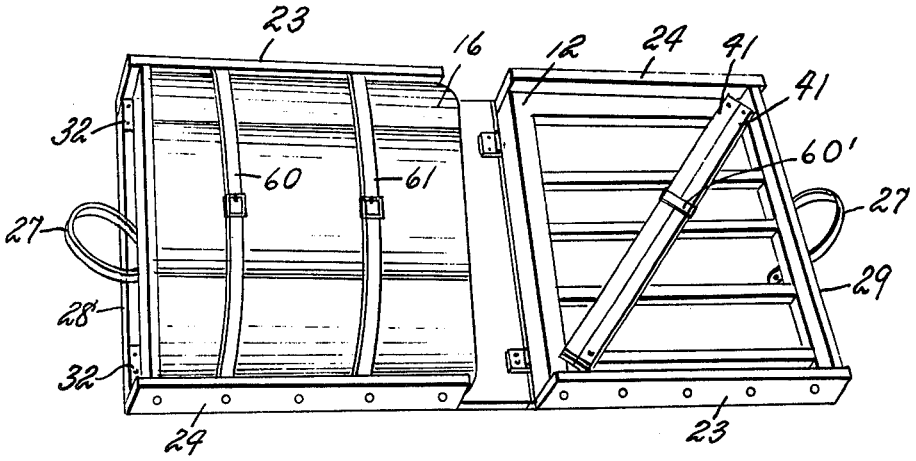
FIG. 2 is a view in perspective showing a first step in the manipulation of the embodiment to erected condition.
Figure 3:
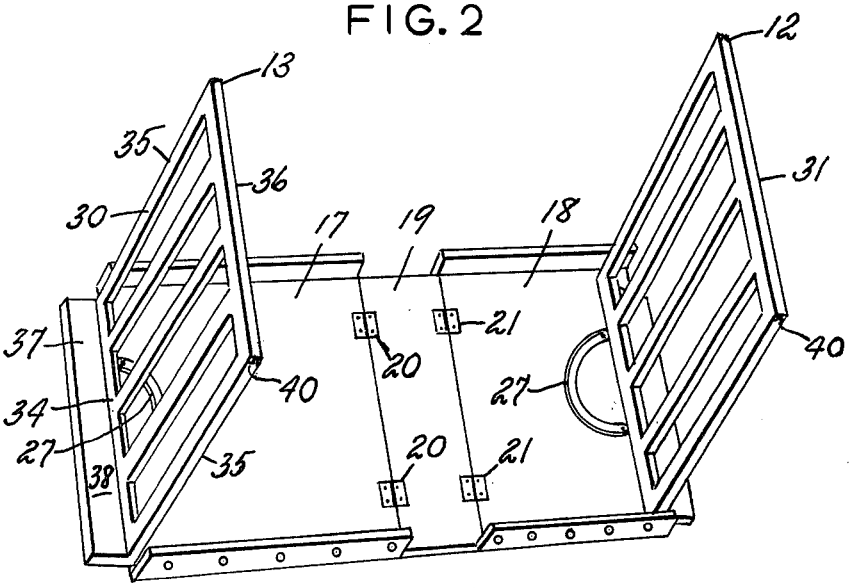
FIG. 3 is a view in perspective showing a further step.
Figure 4:
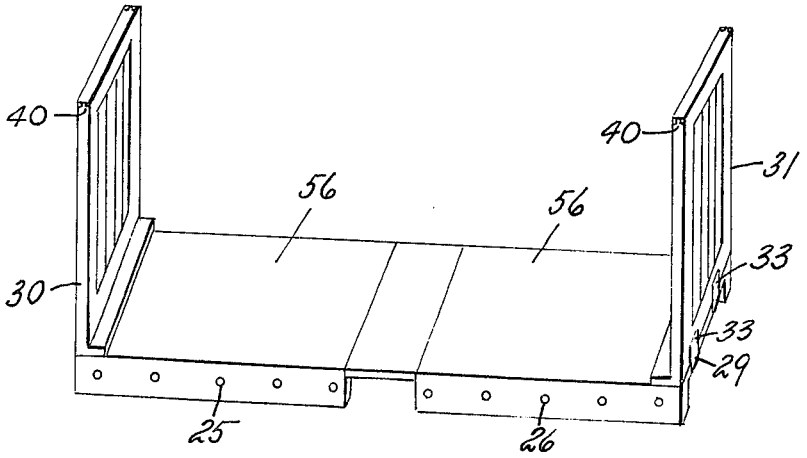
FIG. 4 is a view in perspective showing a step subsequent to that shown in FIG. 3.

Selectively interconnected by flush mount hinge means 40 are a pair of elongated wood rail members 41, which, because of their length, are preferably formed as first and second sections 42–43 interconnected by hinge means 44 and maintained in coaxially aligned relation by catch structure 45 which form rigid parts of the side wall elements 14. When in stored condition, they are folded about means 44 and held in position as shown in FIG. 2 by a strap 60' held by snap fasteners (not shown). When disconnected, the rail elements may be removed, and the end wall 12 thereafter rotated to erect condition. The rail members 41 support canvas or cloth wall members 46, the upper edges 47 of which are hemmed at 48 to provide a rail receiving channel 49. The vertical side edges 50 thereof abut the end walls 30–31. The lower edges 51 are provided with resilient fastener elements 52 cooperating with corresponding elements 53 on the base element 11.

Figure 6:
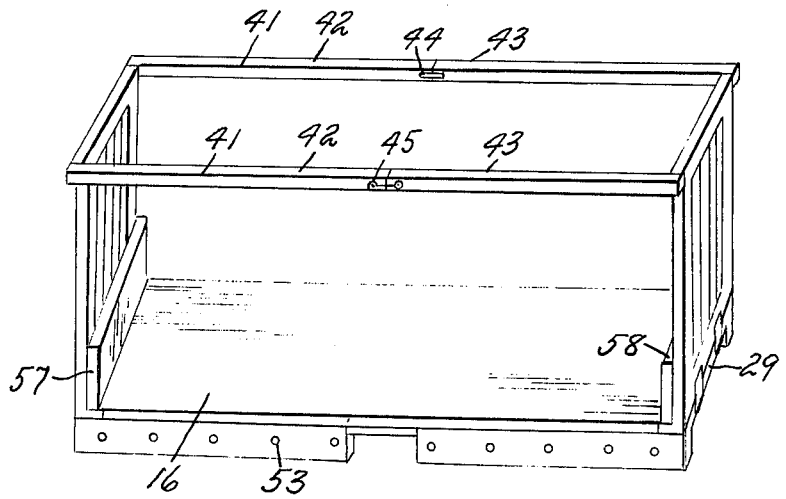
FIG. 6 is a view in perspective similar to that in FIG. 5, but showing certain of the component parts removed to show detail.
Figure 5:
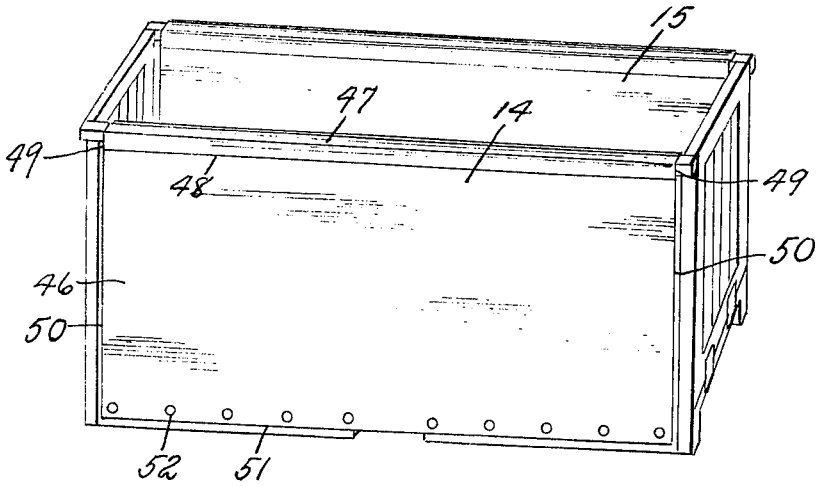
FIG. 5 is a view in perspective showing the embodiment in fully erected condition and ready for use.

As seen in FIG. 2, the mattress 16 is a foldable type, preferably formed from synthetic resinous foam and encloses the soft end bumpers 57 and 58 (FIG. 6). The straps 60 and 61 hold the mattress, bumpers and folded side walls 46 in stored condition, and when opened, and the mattress, bumpers and side walls removed, the end wall element 12 may be rotated.

Assembly of the device is commenced by opening the latches 25 and 26, following which the walls 17 and 18 are allowed to move to coplanar position (see FIG. 2). The device is then supported along longitudinally extending flanges 23 and 24, while the end wall elements are rotated through substantially 270° wherein the flanges 37 overlie the previous outer surfaces 56 of each of the walls 17 and 18. Because of the manner in which the hinges 32 and 33 are set in, there is adequate space for the strap handles 27 to be tucked in so as not to interfere with the above rotation.

The device is then turned so as to be supported upon the free edges of the flanges 23–24. This will have the effect of elevating the surfaces 56 a distance above a supporting floor equal to the width of the flanges 23–24, and provide a partially enclosed air space therebetween.

Next the rail members 41 are moved from folded condition in which they were stored to a position in which the sections 42 and 43 are coaxially aligned. This position is secured by engaging the means 45, as mentioned hereinabove.

Following this step, the canvas side walls 46 are unfolded, and the now-erect rail members are inserted into the corresponding channels 49. The rail members may then be interconnected to the means 40 on the end wall elements 12 and 13, and the fasteners 52 and 53 are engaged.

At this point, the side walls are placed in substantial tension, and the entire crib becomes relatively rigid. The mattress 16 is then placed upon the exposed upper surface 56 and bumpers 57 and 58 which have been stored beneath the folded mattress are positioned on end wall elements 12 and 13 by fastener means (not shown) similar to 52 and 53. This completes the assembly.

Returning the device to stored condition involves merely the reverse of the above described operations, which permits the device to be readily carried using a single hand.

I wish it to be understood that I do not consider the invention limited to the precise details of structure shown and set forth in this specification, for obvious modifications will occur to those skilled in the art to which the invention pertains.

I claim:

1. In a folding crib structure of a type including a hingedly connected base element, a pair of end wall elements, hingedly interconnected to free end edges of said base element, the improvement comprising: said base element including end wall elements and longitudinally extending flanges defining a cavity for the retention of said side wall elements when in folded condition, hinge means interconnecting said end wall elements for rotation through a substantially 270° path of movement, said end walls having laterally extending flanges thereon lying in a plane substantially at right angles relative to the plane of the respective end wall, said laterally extending flanges forming limiting means engaging said base element when said end walls are in fully extended condition, and forming part of a storage enclosure when said structure is in folded condition; a pair of elongated upper rail elements selectively interconnecting said end wall elements when in erected condition, and tensing said end wall elements against said limiting means; and a pair of foldable planar side wall elements of generally rectangular configuration having means along an upper edge thereof selectively engaging said rail elements and at a lower edge thereof selectively engaging a horizontal edge of said base element.

2. Crib structure in accordance with claim 1, further characterized in said longitudinally extending flanges forming, when said structure is in folded condition, part of a storage enclosure, and when said structure is in erected condition, serving to elevate said base element a substantial distance above a supporting floor.

3. Crib structure in accordance with claim 1, further characterized in said side wall elements forming a channel along an upper edge thereof into which said rail elements are inserted, said side wall elements including a plurality of resilient fastener elements along a lower edge thereof, selectively engageable with corresponding fastener elements on said lower edge of said base element.

* * * * *